US007491890B2

(12) United States Patent
Debladis et al.

(10) Patent No.: US 7,491,890 B2
(45) Date of Patent: Feb. 17, 2009

(54) ELECTRIC WIRE HAVING A CORE OF ALUMINUM OR ALUMINUM ALLOY

(75) Inventors: Francis Debladis, Arras (FR); Christophe Brismalein, Lievin (FR)

(73) Assignee: Nexans (FR)

( * ) Notice: Subject to any disclaimer, the term of this patent is extended or adjusted under 35 U.S.C. 154(b) by 0 days.

(21) Appl. No.: 11/350,256

(22) Filed: Feb. 8, 2006

(65) Prior Publication Data

US 2006/0283622 A1 Dec. 21, 2006

(30) Foreign Application Priority Data

Feb. 10, 2005 (FR) ..... 05 50399

(51) Int. Cl.
*H01B 5/00* (2006.01)

(52) U.S. Cl. ..... 174/126.1; 174/128.1

(58) Field of Classification Search ..... 174/126.1, 174/126.2, 128.1, 128.2
See application file for complete search history.

(56) References Cited

U.S. PATENT DOCUMENTS 3,254,970 A * 6/1966 Dittrich et al. ..... 428/570
3,256,071 A * 6/1966 Singleton, Jr. ..... 428/601
3,636,242 A 1/1972 Hansson ..... 174/128
3,909,209 A 9/1975 Kruper et al. ..... 129/183.5
4,746,408 A * 5/1988 Hyner et al. ..... 428/624
2005/0082051 A1* 4/2005 Hashimoto et al. ..... 165/184
2006/0201820 A1* 9/2006 Opaskar et al. ..... 205/246

FOREIGN PATENT DOCUMENTS

JP 06-073591 * 4/1994
JP 2003-229192 8/2003
JP 2004-139832 5/2004

OTHER PUBLICATIONS

French Search Report- Oct. 10,2005.

* cited by examiner

*Primary Examiner*—Chau N Nguyen
(74) *Attorney, Agent, or Firm*—Sofer & Haroun, LLP

(57) ABSTRACT

The invention relates to an electric wire comprising an aluminum or aluminum alloy core provided with a coating layer of zinc and nickel alloys. According to the invention, the content by weight of nickel in the alloy lies in the range 5% to 15%.

8 Claims, 1 Drawing Sheet

ELECTRIC WIRE HAVING A CORE OF ALUMINUM OR ALUMINUM ALLOY

RELATED APPLICATIONS

This application is related to and claims the benefit of priority from French Patent Application No. 05 50399, filed on Feb. 10, 2005, the entirety of which is incorporated herein by reference.

FIELD OF THE INVENTION

The invention relates to an electric wire having a core of aluminum or aluminum alloy.

BACKGROUND OF THE INVENTION

When an aluminum or aluminum alloy wire is crimped in a crimping sleeve, and given the difference in the thermal expansion coefficients of aluminum and the metal constituting the crimping sleeve, which is often a copper alloy, alumina is formed around the wire by oxidation in air. Unfortunately, alumina is electrically resistive and consequently leads to an increase in electrical contact resistance, which can lead to contact being broken, when conveying light currents, or else to overheating, when conveying heavy currents.

OBJECT OF THE INVENTION

The object of the invention is to avoid this formation of a layer of aluminum around at the electric wire by coating the wire in a material that does not present insulating properties that are harmful to good electrical operation of the conductor.

U.S. Pat. No. 3,636,242 discloses an electric wire with a core of aluminum or aluminum alloy provided with a coating layer of zinc and nickel alloy, the content by weight of nickel in the alloy lying in the range 25% to 75%.

That arrangement presents the following technical problems.

Zinc is more electronegative than aluminum and plays a sacrificial role in the event of galvanic corrosion. A high proportion of nickel alloyed to the zinc decreases this protective property.

Furthermore, the cost of zinc is much lower than the cost of nickel, and such an arrangement is therefore expensive in proportion to the nickel content used.

Finally, co-deposition of nickel and zinc makes it possible to improve the resistance to corrosion compared with depositing pure zinc.

The invention enables a compromise to be found between these various criteria constituted by resistance to corrosion, including to galvanic corrosion, and the cost of a wire having a core of aluminum or aluminum alloy.

BRIEF SUMMARY OF THE INVENTION

To do this, the invention proposes an electric wire comprising a core of aluminum or aluminum alloy provided with a coating layer of zinc and nickel alloy, wherein the content by weight of nickel in the alloy lies in the range 5% to 15%, ignoring ordinary impurities.

In a preferred embodiment, said zinc and nickel alloy is a co-deposition on said core, i.e. the zinc and the nickel are alloyed while they are being deposited on the core of aluminum or aluminum alloy.

Preferably, the thicknesses said coating layer lies in the range 0.1 micrometers (μm) to 10 μm on the finished wire.

Advantageously, said coating layer is deposited on the conductor by electrodeposition.

Said coating layer may optionally be passivated, e.g. by chromium, molybdate, or phosphate, in order to increase its resistance to corrosion.

The invention also relates to a single strand electric conductor constituted by a wire as specified above.

Finally, the invention relates to a multistrand electric conductor made by assembling together a plurality of wires as specified above.

BRIEF DESCRIPTION OF THE DRAWING

The invention is described below in greater detail with reference to the figures that show merely a preferred embodiment of the invention.

MORE DETAILED DESCRIPTION

Figure 1:
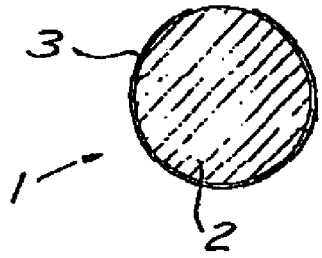
FIG. 1 is a cross-section view of an electric wire in accordance with the invention.

As can be seen in FIG. 1, a wire 1 comprises a core 2 of aluminum or aluminum alloy provided with a coating layer 3 of zinc and nickel alloy, advantageously a co-deposit of zinc and of nickel.

According to the invention, the content by weight of nickel in the alloy lies in the range 5% to 15%. The thickness of the coating layer 3 lies in the range 0.1 μm to 10 μm.

In order to further passivate this alloy against oxidation, the alloy may also be treated by being chromated, by molybdate, or by phosphate, or the equivalent. This treatment may be implemented by dipping the coated wire.

An electric wire in accordance with the invention is manufactured by wire-drawing. The coating layer 3 is deposited by electrodeposition on the core in an intermediate state, and then the core and the coating layer are drawn down together to the final diameter.

The invention is preferably applied to aluminum or aluminum alloy wires having a diameter lying in the range 0.08 millimeters (mm) to 12 mm in their final state after being drawn.

Figure 2:
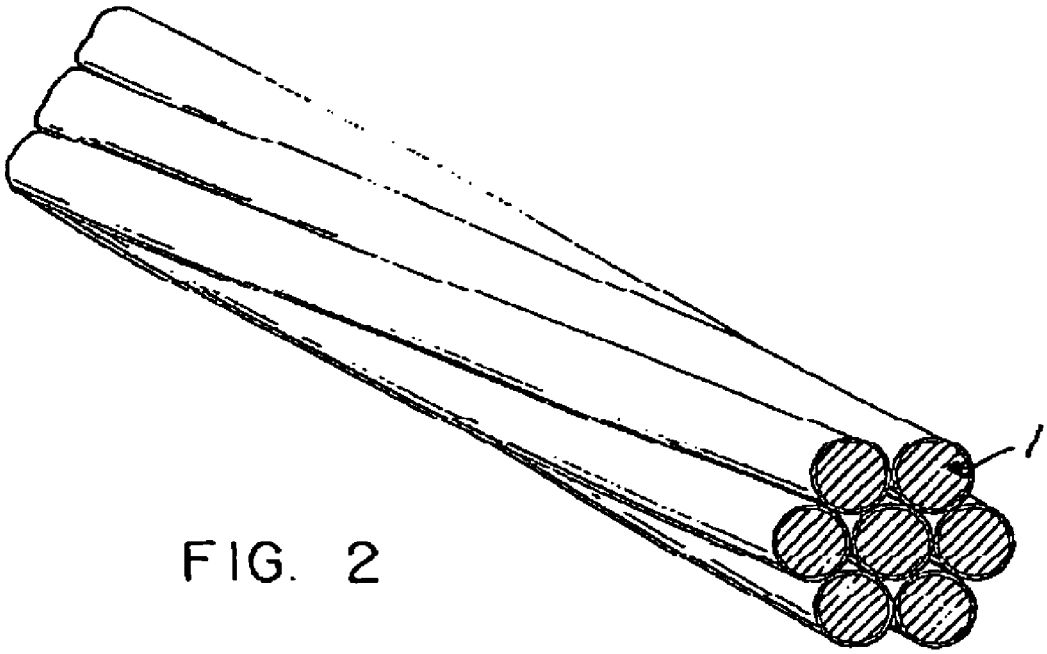
FIG. 2 is a perspective view of an electric conductor made up of wires in accordance with the invention.

Wires 1 as obtained in this way can be assembled and twisted together to form a multistrand electric conductor as shown in FIG. 2.

The invention also applies to wires of large diameter suitable for making a single strand conductor.

What is claimed is:

1. An electric wire for transmission of electricity comprising:

an aluminum or aluminum alloy core provided with a coating layer of zinc and nickel alloy, wherein the content by weight of nickel in the alloy lies substantially within the range 5% to 15%.

2. An electric wire according to claim 1, wherein said zinc and nickel alloy is a co-deposit on said core.

3. An electric wire according to claim 1, wherein the thickness of said coating layer lies in the range 0.1 μm to 10 μm.

4. An electric wire according to claim 1, wherein said coating layer is deposited on the core by electrodeposition.

5. An electric wire according to claim 1, wherein said coating layer is passivated.

6. An electric wire according to claim 5, wherein said coating layer is passivated by any one of chromium, molybdate, or phosphate.

7. A single strand electric conductor made by a wire according to claim 1.

8. An electric wire for transmission of electricity comprising:

a multistrand electric conductor made by assembling together a plurality of wires, wherein each wire is an aluminum or aluminum alloy core provided with a coating layer of zinc and nickel alloy, wherein the content by weight of nickel in the alloy lies substantially within the range 5% to 15%.

* * * * *